US005132744A

United States Patent [19]

Maruta et al.

[11] Patent Number: 5,132,744

[45] Date of Patent: Jul. 21, 1992

[54] HEATING DEVICE USING FILM HAVING CONDUCTIVE PARTING LAYER

[75] Inventors: Hidekazu Maruta, Hachioji; Akira Yamamoto, Tokyo; Kensaku Kusaka, Kawasaki; Shigeo Kimura, Yokohama; Atsushi Hosoi, Kawasaki, all of Japan

[73] Assignee: Canon Kabushiki Kaisha, Tokyo, Japan

[21] Appl. No.: 658,244

[22] Filed: Feb. 20, 1991

[30] Foreign Application Priority Data

Feb. 20, 1990 [JP] Japan ..... 2-040229

[51] Int. Cl.[5] ..... G03G 15/20

[52] U.S. Cl. ..... 355/282; 355/219; 361/221; 361/225

[58] Field of Search ..... 355/282, 284, 219, 212, 355/274; 219/216, 388; 361/221, 225

[56] References Cited

U.S. PATENT DOCUMENTS

| | | | |
|---|---|---|---|
| 3,578,797 | 5/1971 | Hodges et al. | 263/3 |
| 4,073,583 | 2/1978 | Teumer et al. | 355/274 X |
| 4,954,845 | 9/1990 | Yano et al. | 355/290 |
| 4,998,121 | 3/1991 | Koh et al. | 346/160 |
| 5,026,276 | 6/1991 | Hirabayashi et al. | 432/59 |
| 5,027,160 | 6/1991 | Okada et al. | 355/282 |

FOREIGN PATENT DOCUMENTS

| | | | |
|---|---|---|---|
| 0295901 | 12/1988 | European Pat. Off. | 355/284 |
| 51-29825 | 3/1976 | Japan . | |
| 60-41070 | 3/1985 | Japan | 355/282 |
| 62-134660 | 6/1987 | Japan | 355/219 |

OTHER PUBLICATIONS

Guewa et al, "Method for Regulating Web Charge", Research Disclosure, May 1978, p. 59, No. 16974.

*Primary Examiner*—Joan H. Pendergrass
*Assistant Examiner*—Shuk Y. Lee
*Attorney, Agent, or Firm*—Fitzpatrick, Cella, Harper & Scinto

[57] ABSTRACT

A heating apparatus includes a heater; a film movable in contact with a recording material carrying an image, wherein the image is heated from the heater through the film; the film having an insulative heat resistive resin base layer at a side near the heater and a parting layer containing conductive material at a side near the recording material; a conductive member contacted or close to the base layer of the film; and a potential maintaining device for maintaining substantially the same potential of the parting layer and the conductive member.

18 Claims, 3 Drawing Sheets

HEATING DEVICE USING FILM HAVING CONDUCTIVE PARTING LAYER

FIELD OF THE INVENTION AND RELATED ART

The present invention relates to a heating apparatus for heating a visualized image on a recording material to fix it or to improve the surface property of the image.

In a widely used conventional image fixing apparatus wherein the toner image is fixed on the recording material supporting an unfixed toner image, the recording material is passed through a nip formed between a heating roller maintained at a predetermined temperature and a pressing or back-up roller having an elastic layer and press-contacted to the heating roller.

This system involves a problem that a high temperature off-set or low temperature off-set tends to occur. In order to solve the problem, U.S. Pat. No. 3,578,797 and Japanese Laid-Open Patent Application No. 29825/1976 have proposed that the toner image is heated through a belt.

In addition the conventional heating roller type fixing system involves the problem that the warming up period until the surface temperature of the heating roller reaches a predetermined level is long.

U.S. Ser. Nos. 206,767, 387,970, now U.S. Pat. No. 4,954,845, 409,341, 416,539, now U.S. Pat. No. 4,998,121, 426,082, now U.S. Pat. No. 5,026,276, 435,247, 430,437, 440,380, 440,678, 444,802 and 446,449 now U.S. Pat. No. 5,027,160, have proposed that the toner image is heated through a thin sheet.

When the recording material is heated through the belt or sheet, the belt or the sheet is triboelectrically charged, resulting in electrostatic toner off-set, scattering of unfixed toner image and/or leakage of the electric charge. These problems would be solved by using electrically conductive belt or sheet having a low resistance which is grounded. However, when a thin film is used, the strength decreases if the conductive material is incorporated therein often, to such an extent that the strength thereof is insufficient.

It has been considered that a pure (not containing filler material) heat resistive resin base be coated with a parting layer having a low resistance containing conductive material so as to provide the sufficient strength and the sufficient conductivity.

However, if a conductive member such as a metal tension roller is close to or in contact with the inside of the film, that is, the insulative heat resistive resin base, the electric charge may leak from the parting layer to the conductive member with the result of the toner scattering or local electrostatic toner offset.

SUMMARY OF THE INVENTION

Accordingly, it is a principal object of the present invention to provide a heating apparatus using a film having a pure heat resistive base layer.

It is another object of the present invention to provide a heating apparatus wherein the electric leakage from the conductive parting layer of the film to a metal roller, is prevented.

It is a further object of the present invention to provide a heating apparatus wherein the toner scattering and electrostatic toner off-set are effectively prevented.

It is a yet further object of the present invention to provide a heating apparatus wherein the electric potentials of the parting layer of the film and a conductive member contactable to the heat resistive resin base layer, are maintained at the same potential.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 6:
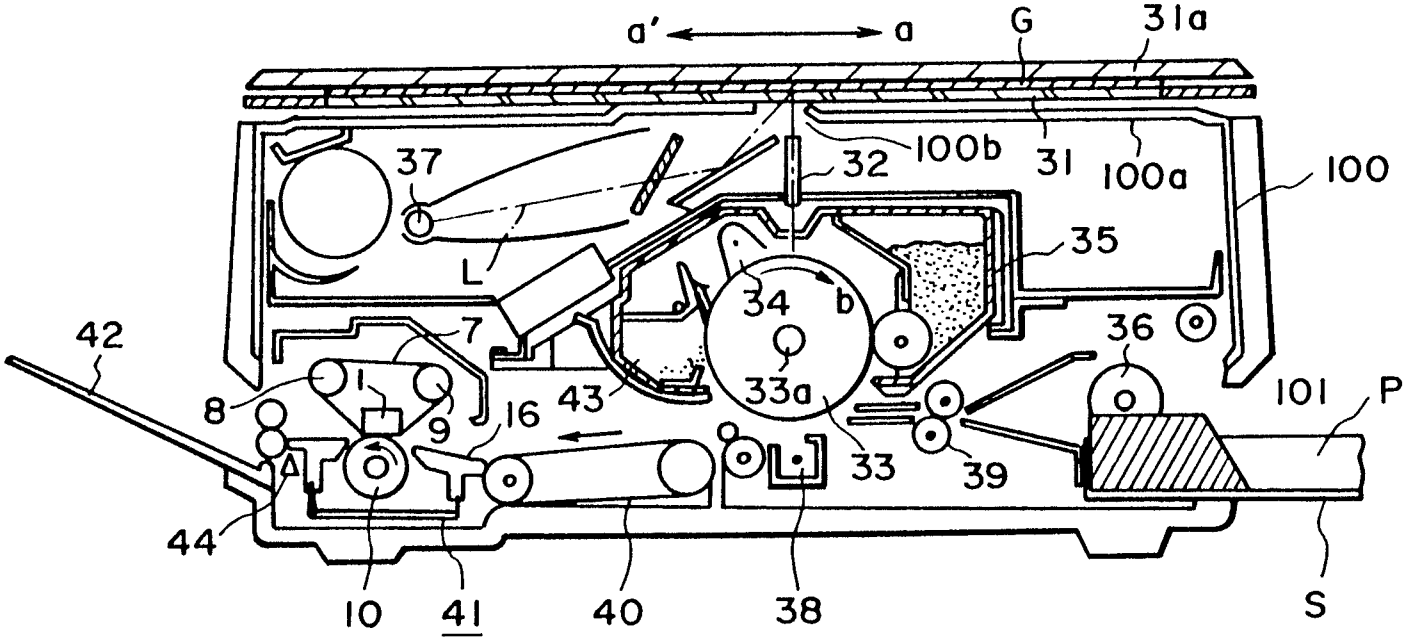
FIG. 6 is a sectional view of an image forming apparatus using the heating apparatus of this invention.

Referring first to FIG. 6, there is shown an electrophotographic image forming apparatus. It comprises a casing 100, a reciprocable original carriage 31 made of transparent material such as glass, disposed on a top plate 100*a* of the casing. The original carriage reciprocates above the top plate 100*a* in the directions a and a'.

An original G is placed face down on the original carriage 31 at a predetermined reference position. Then, the original G is covered with an original cover 31*a*.

The top plate 100*a* is provided with a slit 100*b* (original illuminating portion) formed extending perpendicularly to the reciprocal movement direction of the original supporting carriage 34 (perpendicular to the sheet of the drawing). The bottom surface of the original G placed on the carriage 31 sequentially passes by the slit 100*b* from the right side to the left side during the rightward stroke (a) of the original carriage 31. During the passage, the original G is illuminated with the light L from a lamp 37 through the slit 100*b* and the transparent original supporting platen 31. The light reflected by the original is projected onto a surface of a photosensitive drum 33 through a short focus small diameter imaging element array 32, as an image.

The photosensitive drum 33 has a photosensitive layer made of zinc oxide photosensitive material, an organic photoconductive material or the like. The photosensitive drum 33 is rotated in the clockwise direction b at a predetermined speed about the central axis 33*a*. During the rotation, the surface of the photosensitive drum 33 is uniformly charged by a charger 34 to a positive or negative polarity. Then, the surface is exposed to the light image through the slit, so that an electrostatic latent image is formed on the surface of the photosensitive drum 33.

The electrostatic latent image is sequentially developed by a developing device 35 with powdery toner comprising heat-fusible resin material or the like. The visualized image thus provided is fed to an image transfer station having a transfer discharger 38.

A recording material (transfer sheet P) is contained in a cassette S. The sheet in the cassette S is picked up one-by-one by a pick-up roller 36. Then, it is fed to the photosensitive member by registration rollers 39 in such a timed relation with a leading edge of the toner image on the drum 33 is aligned with the leading edge of the transfer sheet P arriving at the transfer station. The toner image is sequentially transferred from the photosensitive drum 33 to the surface of the sheet by a transfer discharger 38.

The sheet now having the transferred toner image is sequentially separated from the surface of the photosensitive drum 33 by an unshown separating means and is conveyed to an image fixing device 41 along a conveying guide 40. The fixing apparatus 41 which will be described in detail thereafter heats the toner image to fix it. The, transfer sheet is then discharged to the sheet discharge tray 42 as a print (copy).

On the other hand, the surface of the photosensitive drum 33 after the toner image is transferred, is cleaned by a cleaning device 43, by which the residual toner or other contaminations are removed, and therefore, is prepared for the next image forming operation.

The description will be made as to the heat fixing apparatus according to an embodiment of the present invention.

Figure 1:
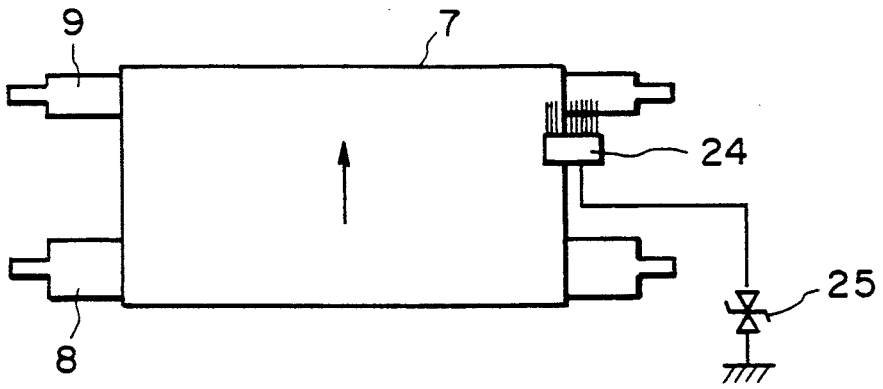
FIG. 1 is a top plan view of a heat-fixing apparatus according to an embodiment of the present invention.
Figure 2:
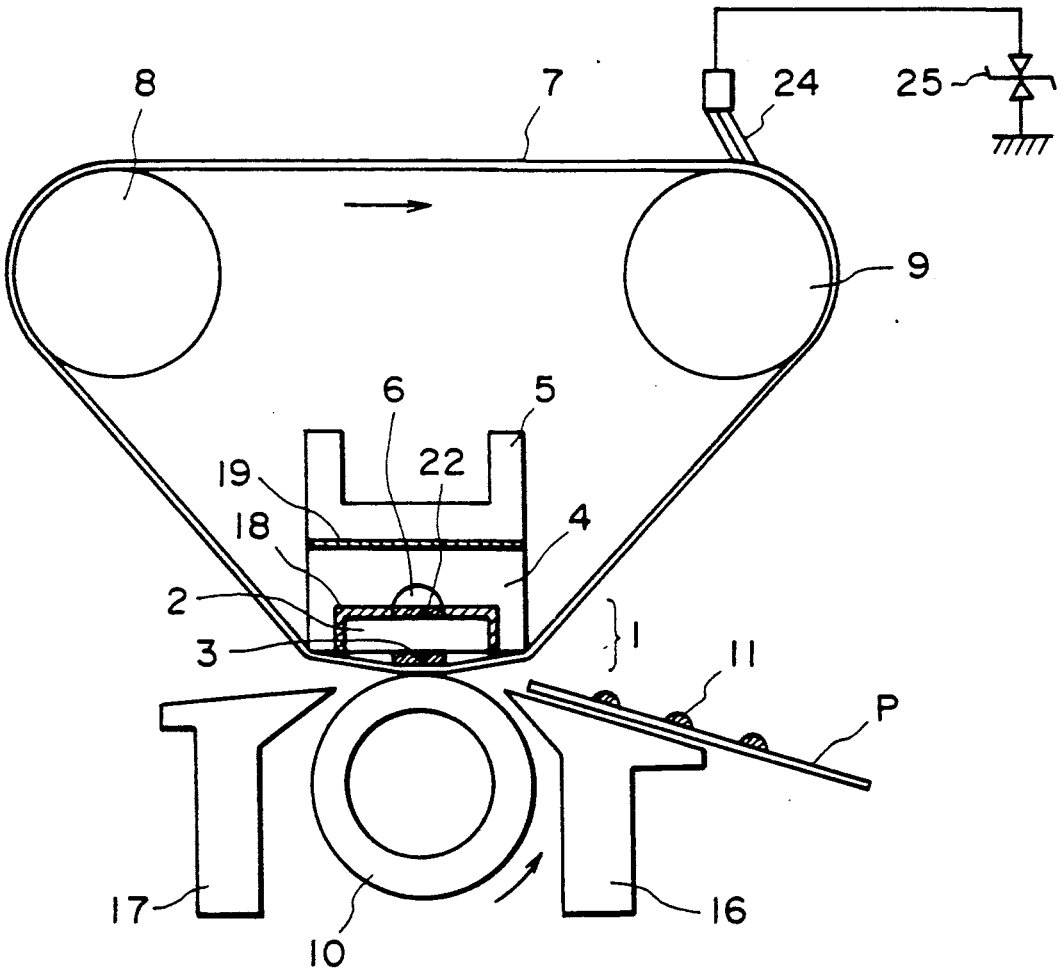
FIG. 2 is a sectional view of the apparatus of FIG. 1.

FIGS. 1 and 2 show the image fixing apparatus according to this embodiment, wherein FIG. 1 is a top plan view, and FIG. 2 is a sectional view. The heat fixing apparatus comprises a low thermal capacity linear heater 1 having an alumina base 2 having, for example, a thickness of 1.0 mm, a width of 10 mm and a length of 240 mm, and a resistor material 3 applied thereon with a width of 1.0 mm. The resistor material 3 is connected with an electric power source at its opposite longitudinal ends. The heater 1 is fixed on a holder 4 by a bonding agent 18, and the holder 4 is in turn fixed on a supporting frame 5 by a bonding agent 19. The electric power supply thereto is made by DC 100 V having a period of 20 msec in the form of a pulse wave. The pulse width is changed in accordance with the emission of the energy, more particularly, in order to provide a predetermined temperature level detected by the temperature detecting element 6. The temperature detecting element 6 is bonded to the heater 1 by a bonding agent 22. The power width is generally 0.5 msec -5 msec. An image fixing film 7 is movable in the direction indicated by an arrow in contact with the heater 1 thus temperature controlled.

As an example of the fixing film, it comprises a pure heat resistive resin film not containing filler material and having a thickness of 20 microns, which is of polyimide (PI), polyether imide (PEI), tetrafluoro-ethylene-perfluorovinylether copolymer (PFA) or the like, and a parting layer, at least at an image contactable side thereof, which comprises fluorinated resin material such as polytetrafluoroethylene (PTFE), tetrafluoroethylene-perfluorovinylether copolymer or the like and conductive material so as to provide a surface resistance of $10^7$ ohm. The parting layer has a thickness of approximately 10 microns which is smaller than the thickness of the heat resistive resin film. The film is in the form of an endless belt. The parting layer preferably has a surface resistance of not more than $10^{10}$ ohm from the standpoint of preventing electric charge-up. In order to provide good heat transfer from the heater to the toner, the total thickness of the film is preferably not more than 100 microns. Further preferably, not more than 10 microns. The film is stretched around and between a driving roller 8 and a metal follower roller 9 having a length larger than the width of the film. The film is driven by the driving roller 8 under the tension in the direction indicated by an arrow without crease.

A pressing roller 10 has a rubber elastic layer having a good parting property. It urges the film to the heater under the total pressure of 4–7 kg and rotates together with the film.

Upon electric power supply to the heater, the film 7 rotating by the driving roller 8 is heated and maintained at a predetermined temperature. Then, a transfer material P carrying a toner image 11 not yet fixed is fed, heated and pressed by the heater 1, the film 7 and the pressing roller 10, so that the image is fixed on the transfer material P. In this embodiment, the follower roller 9 for applying tension to the fill made of metal so that the follower roller 9 has a lower frictional coefficient relative to the film than the driving roller 8.

An electrically conductive brush 24 contacted both to the follower roller and the parting layer of the film, is disposed adjacent an end of the film. The conductive brush 24 is grounded through a varister 25. The follower roller 9 is supported by an unshown insulative bearing, and therefore, the potential of the follower roller 9 is maintained at the varister potential.

Even if the frictional charge is produced by the rotation of the film 7, the coating (low resistance) side of the film 7 and the follower roller are in direct contact with the conductive brush 24, and therefore, they are maintained at the same varister potential.

Additionally, the inside of the insulative heat resistive resin film at the film inside is also in contact with the metal roller, and therefore, the potential thereof is close to the varister potential.

Accordingly, the leakage of the electric charge is sufficiently prevented, also in the other driving roller.

The volume retentivity of the follower roller 9 is preferably not more than $10^{10}$ ohm.cm, further preferably not more than $10^3$ ohm.cm.

In this embodiment, the follower roller 9 is conductive, and it is contacted to the conductive brush 24 together with the film 7. However, the driving roller 8 may be made conductive, and the brush 24 grounds the film 7 adjacent the driving roller. The varister 25 may be replaced with a resistor, and may be omitted if desired. The advantageous effects were provided in those cases.

If desired, the conductive brush 24 may be disposed close to the film 7 or the follower roller 9. This modification is advantageous from the standpoint of prevention of the wearing of the film.

It is a possible alternative that the electric potentials of the parting layer and the metal roller are made the same using separate conductive members maintained at the same potential. However, use of one conductive member contacted to both is preferable because the same potential level is assured with simpler structure.

Figure 3:
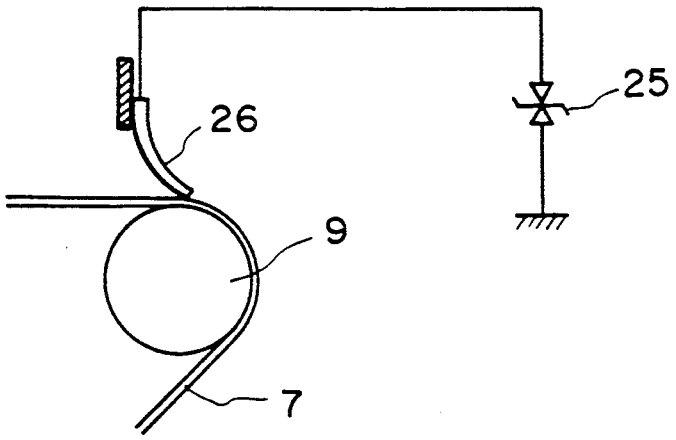
FIGS. 3 and 4 are enlarged sectional views of the apparatus.

FIG. 3 shows another embodiment, wherein a conductive blade is used in place of the conductive brush.

Figure 4:
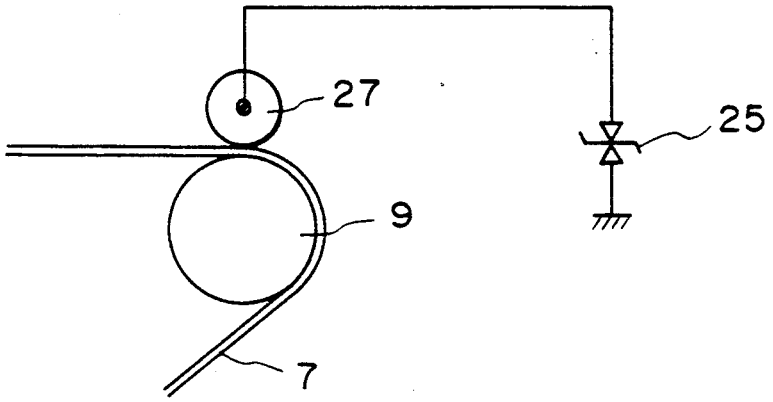

FIG. 4 shows a further embodiment, wherein the electric discharging is provided by a conductive roller.

Figure 5:
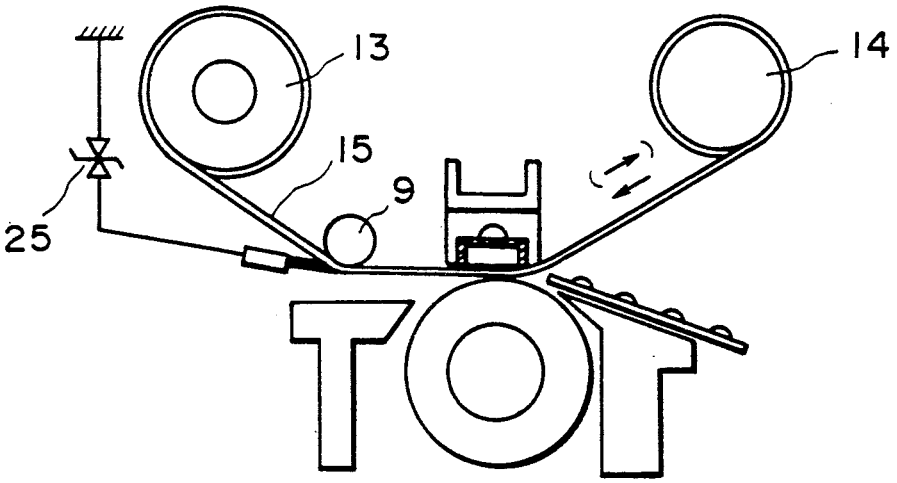
FIG. 5 is a sectional view of a heat fixing apparatus according to another embodiment of the present invention.

FIG. 5 shows a yet further embodiment, wherein in place of the endless film 7, a non-endless film 15 is used. The film 15 is unwound and rewound by a feeding roller 13 and a take-up roller 14.

In these embodiments, the film and the member contacted to the film can be discharged by a single discharging member, by which the charge offset or charge leakage can be prevented.

As described in the foregoing, according to the present invention, the charge offset and/or the charge leakage are effectively prevented, which may otherwise be caused by the charging of the film, the charge-up of a conductive member contacted to the internal surface of the film.

While the invention has been described with reference to the structures disclosed herein, it is not confined to the details set forth and this application is intended to cover such modifications or changes as may come within the purposes of the improvements or the scope of the following claims.

What is claimed is:

1. A heating apparatus, comprising:

a heater;

a film movable in contact with a recording material carrying an image, wherein the image is heated from said heater through said film;

said film comprising an insulative heat resistive resin base layer at a side near said heater and a parting layer containing conductive material at a side near the recording material;

a conductive member contacted or close to the base layer of said film; and potential maintaining means for maintaining substantial equality between a potential of said departing layer and a potential of said conductive member.

2. An apparatus according to claim 1, wherein said conductive member is a tension member for applying tension to said film.

3. An apparatus according to claim 2, wherein said tension member is of metal.

4. An apparatus according to claim 2, wherein said tension member is a roller rotating following said film.

5. An apparatus according to claim 1, wherein said conductive member extends beyond a width of said film.

6. An apparatus according to claim 1, wherein said potential maintaining means maintains a predetermined potential of said parting layer and said conductive member.

7. An apparatus according to claim 6, wherein said potential maintaining member grounds said parting layer and said conductive member through a constant voltage element.

8. An apparatus according to claim 7, wherein said constant voltage element is common for said parting layer and said conductive member.

9. An apparatus according to claim 1, wherein said potential maintaining means has a second conductive member in contact both with said parting layer and said conductive member.

10. An apparatus according to claim 9, wherein said second conductive member includes a conductive brush.

11. An apparatus according to claim 1, wherein said film is in the form of an endless belt.

12. An apparatus according to claim 1, wherein said base layer is in sliding contact with said heater.

13. An apparatus according to claim 1, wherein said conductive member has a volume retentivity of not more than $10^{10}$ ohm.cm.

14. An apparatus according to claim 13, wherein said conductive member has a volume retentivity of not more than $10^{3}$ ohm.cm.

15. An apparatus according to claim 1, wherein said base layer has a surface retentivity of not less than $10^{15}$ ohm.

16. An apparatus according to claim 1, wherein said parting layer has a surface retentivity of not more than $10^{10}$ ohm.

17. An apparatus according to claim 1, wherein said film has a total thickness not more than 100 microns.

18. An apparatus according to claim 17, wherein said film has a total thickness of not more than 40 microns.

* * * * *

UNITED STATES PATENT AND TRADEMARK OFFICE

CERTIFICATE OF CORRECTION

PATENT NO. : 5,132,744

DATED : July 21, 1992

INVENTOR(S) : MARUTA et al.

It is certified that error appears in the above-identified patent and that said Letters Patent is hereby corrected as shown below:

COLUMN 3

Line 11, "The," should read --The--.

COLUMN 5

Line 24, "departing" should read --parting--.

COLUMN 6

Line 22, "retentivity" should read --resistivity--.
Line 25, "retentivity" should read --resistivity--.
Line 28, "retentivity" should read --resistivity--.
Line 31, "retentivity" should read --resistivity--.

Signed and Sealed this

Fourteenth Day of September, 1993

Bruce Lehman

*Attest:*

BRUCE LEHMAN

*Attesting Officer*

*Commissioner of Patents and Trademarks*